US008056357B2

(12) United States Patent
Bruce

(10) Patent No.: US 8,056,357 B2
(45) Date of Patent: Nov. 15, 2011

(54) METHOD AND DEVICE FOR ENSURING MAINTAINED TEMPERATURE INSIDE A TRANSPORT CONTAINER OR THE LIKE

(75) Inventor: Hans Bruce, Fribourg (CH); Catharina Louise Bergenstjerna, legal representative, Geneva (CH); Hans Richard Wilheim Bruce, legal representative, Lidingo (SE); Anna Madeleine Bruce Martinsson, legal representative, Eskilstuna (SE)

(73) Assignee: PermaCool SA, Fribourg (CH)

( * ) Notice: Subject to any disclaimer, the term of this patent is extended or adjusted under 35 U.S.C. 154(b) by 827 days.

(21) Appl. No.: 11/662,485

(22) PCT Filed: Sep. 14, 2005

(86) PCT No.: PCT/SE2005/001333

§ 371 (c)(1),
(2), (4) Date: Mar. 21, 2008

(87) PCT Pub. No.: WO2006/031189

PCT Pub. Date: Mar. 23, 2006

(65) Prior Publication Data

US 2009/0019864 A1 Jan. 22, 2009

(30) Foreign Application Priority Data

Sep. 15, 2004 (SE) ..... 0402205

(51) Int. Cl.

| | |
|---|---|
| ***F25D 3/12*** | (2006.01) |
| ***F25D 11/02*** | (2006.01) |
| ***F25D 3/02*** | (2006.01) |

(52) U.S. Cl. ..... 62/384; 62/459; 62/432

(58) Field of Classification Search ..... 62/384, 62/457.1, 457.2, 457.7, 385, 388, 459, 432
See application file for complete search history.

(56) References Cited

U.S. PATENT DOCUMENTS

| | | | | |
|---|---|---|---|---|
| 1,897,095 | A * | 2/1933 | Wooll | 62/384 |
| 1,963,743 | A | 6/1934 | Hoodless | 62/91 |
| 2,302,639 | A | 11/1942 | Moore | 62/1 |
| 4,294,079 | A | 10/1981 | Benson | 62/60 |
| 4,457,142 | A * | 7/1984 | Bucher | 62/388 |
| 5,417,082 | A | 5/1995 | Foster et al. | 62/457 |
| 5,711,164 | A * | 1/1998 | Slack | 62/457.9 |
| 7,500,593 | B2 * | 3/2009 | Mayer | 229/103.11 |

FOREIGN PATENT DOCUMENTS

| | | |
|---|---|---|
| EP | 0908399 A1 | 4/1999 |
| JP | 4845912 | 4/1973 |
| JP | 5251153 | 4/1977 |
| JP | 5488336 | 6/1979 |
| JP | 5771260 | 5/1982 |
| JP | 63135765 | 6/1988 |

* cited by examiner

*Primary Examiner* — Frantz Jules
*Assistant Examiner* — Cassey D Bauer
(74) *Attorney, Agent, or Firm* — Jacobson Holman PLLC

(57) ABSTRACT

A method and a device for better utilizing latent cold in a cold producing material used for producing and upholding a predetermined temperature inside a transport container or the like, where dry ice or a similar first phase change material having very low sublimation temperature is utilized. Inside the transport container is arranged a receptacle for such low sublimation temperature phase converting material, the said receptacle being provided with an enclosure having cavities for a second phase change material having a considerably higher melting point, the said cavities of the receptacle at least partially enclosing the inside of the receptacle, in which the converting material having the essentially lower melting point is received.

11 Claims, 3 Drawing Sheets

METHOD AND DEVICE FOR ENSURING MAINTAINED TEMPERATURE INSIDE A TRANSPORT CONTAINER OR THE LIKE

This is a national stage of PCT/SE2005/001333 filed 14 Sep. 2005 and published in English.

FIELD OF THE INVENTION

The invention relates to a method and a device for maintaining a temperature adapted to the goods to be transported inside a container forming an essentially closed volume or space by means of a refrigerant placed inside such container, wherein the refrigerant is a phase change material (PCM), having a very low evaporation temperature, intended to bring about and maintain a temperature adapted to the goods inside.

BACKGROUND OF THE INVENTION

It is known to place inside containers and the like receptacles more or less filled with dry ice, i.e. solid carbonic acid or similar PCM, which during the transportation time through the influence of the ambient surrounding temperature is brought to evaporate or sublimate, a process which is difficult to regulate. This result in high dry ice costs and an unsatisfactory function since the temperature inside the container hardly can be controlled as closely as desired.

It is further known to arrange walls at transport boxes and the like provided with preferably closed spaces and fill said spaces with a phase change material (PCM) having a high melting temperature e.g. water. The boxes are before the loading thereof with goods placed in a space so cold that the phase change material is transformed into a solid state. During the transport, the heat necessary for the re-conversion will be collected from the ambient air passing through the box walls leaving the interior more or less unaffected. On long transports, some problems may occur in case the PCM is water or freezing mixtures, since rather large volumes would be necessary in order to keep the desired low temperature inside the transport box interior.

The reason why the first mentioned alternative, i.e. to utilize known phase change materials of very low evaporating temperature type such as dry ice, liquid $CO_2$, liquid nitrogen or the like as a matter of fact, is used rather sparsely, depends on the cost and on the fact that the extremely low temperatures often affect the goods transported in a negative way.

A further drawback likewise important, is that in cases where the goods transported is not allowed to be colder than +/−0° C., the goods has to be insulated from the dry ice containing receptacle holding the evaporating dry ice, which results in a bad and lower utilization of the cold energy of the dry ice and increased handling costs.

AIM AND MOST IMPORTANT FEATURES OF THE INVENTION

The new idea behind the invention lies in utilizing both a first phase change material (PCM) having a very low temperature of evaporation and a second phase change material having a melting point or temperature more closely adapted to the desired temperature of the goods or commodities to be transported. In this way also a lower Δ-t is reached, resulting in a large reduction of the amount of dry ice necessary, a more secure, controllable function and essentially lower consumption and costs for dry ice or similar PCM.

Behind the method according to this invention lies the requirement for making it possible to maintain a desired temperature inside an insulated container or box for transport of temperature sensitive goods, e.g. cold stored or deep frozen foods. Today dry ice is often used for such transports and the dry ice placed in a receptacle placed in the upper part of the insulated transport container. As a result of the high Δ-t (100° C. at 22° C. outside or ambient temperature) a large amount of the latent "cold energy" of the dry ice will escape through the roof and the walls of the container. As heat searches for cold, the heat of the surroundings will quickly pass through the insulation of the container.

A receptacle arranged according to this invention and adapted for dry ice or the like first phase change material, first PCM, has a bottom part, a top part such as a lid and, in some cases also walls made hollow or with internal spaces, adapted to contain a second phase change material, second PCM, which is in a liquid state at normal temperature and thus has a high melting and congealing temperature. The second phase change material, which can be water or water mixtures, is preferably filled into sealed bags or the like flexible receptacles, which in turn are placed into the hollow spaces of the bottom, lid and walls. Naturally, the phase change material may be filled directly into such hollow spaces, but the way of using bags or the like reduces or eliminates the risk for leakage.

The lid of the receptacle is preferably sized in such a way that in can be placed inside the receptacle walls so that it rests upon the dry ice or the first PCM therein. There is, accordingly passages for the evaporated dry ice along the edges of the lid in that embodiment.

Upon filling dry ice or first PCM into the intended part of the receptacle interior and mounting the receptacle inside the transport container, the dry ice starts to evaporate or sublimate, i.e. transform from solid state into gas, and the resulting cold released will affect and transform to solid form the second phase change material inside the lid, bottom and in some cases walls of the receptacle, having the higher solidifying temperature.

When the container holding a temperature sensitive goods is subjected to heat from the surroundings during transport, the heat inside the transport container affects the outsides of the receptacle and seeks to transform into liquid state the phase change material inside the hollow spaces of the receptacle initially transformed into solid state and kept so by influence of the dry ice inside the receptacle. Gradually and finally the said second phase change material just mentioned, under influence of the ambient heat inside the container will be transformed into liquid state. The melting is however retarded by the counter effect given by the dry ice as long as it lasts.

As an advantage it may be mentioned that the temperature inside the goods holding space of the container may be selected within a wide register, e.g. +8, +/−0, −3, −12, −17, −21 or −32° C. according to intended temperature for the goods to be transported simply by selecting an appropriate water mixture.

As mentioned above, Δ-t for dry ice is 100° C. at 22° C. outside or ambient temperature. With a second PCM having a melting temperature at −21° C. the Δ-t will be 43° C. on an outside temperature at 22° C. With a second PCM having a melting point at +/−0° C., Δ-t will be 22 at 22° C. outside temperature.

An important feature of the invention is that the first PCM is surrounded by the second PCM at a high degree. This is the case even if only the bottom and the top parts are provided with spaces for the second PCM which thereby at least partially encloses the inside of the receptacle, in which the first PCM having the essentially lower melting point is received.

The first PCM is then prevented to a high degree from direct influence from the surroundings. It should be noted in this context that the top and bottom parts not necessarily have to be positioned facing upwards and downwards respectively. Also other arrangements are possible even if that orientation is preferred.

It is also preferred that also the walls of the receptacle are provided with spaces for a second PCM. This way the direct influence from the surroundings on the first PCM is minimized.

This aspect, where second PCM surrounds first PCM and the aggregate is positioned in a room to be refrigerated is in contrast to the background art, wherein no such solution is envisaged.

This is very important as the consumption of the latent cold energy of the dry ice filled into the receptacle is directly proportional to the Δ-t of the PCM used.

BRIEF DESCRIPTION OF DRAWING

In the following, the invention will be further explained with references to the attached drawing, which in its figures diagrammatically shows in FIGS. 1 and 2 a cross section through a receptacle according to the invention adapted to be placed inside a transport container, and in FIG. 3 shows a receptacle positioned at an upper part of an inside space of the container.

DESCRIPTION OF EMBODIMENT

Figure 1:
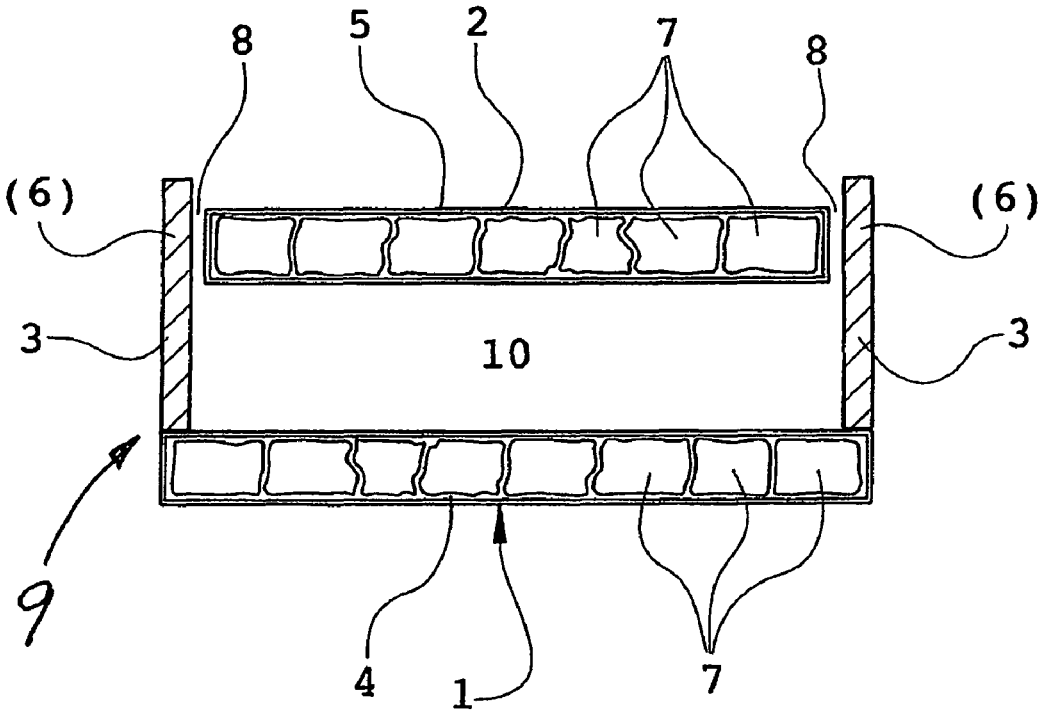
Figure 2:
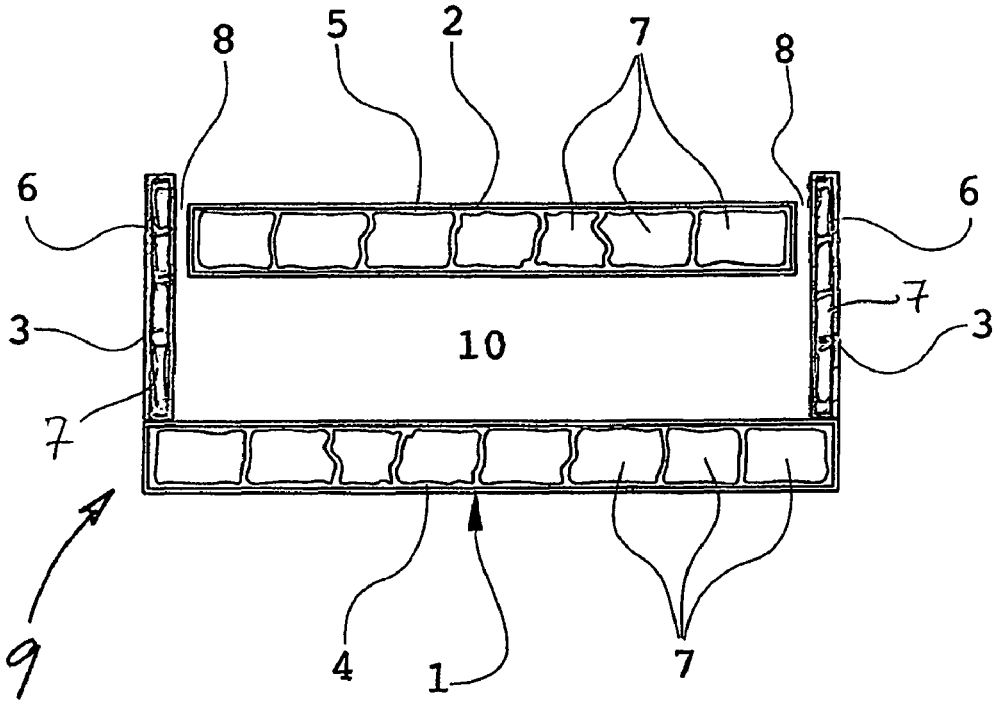
Figure 3:
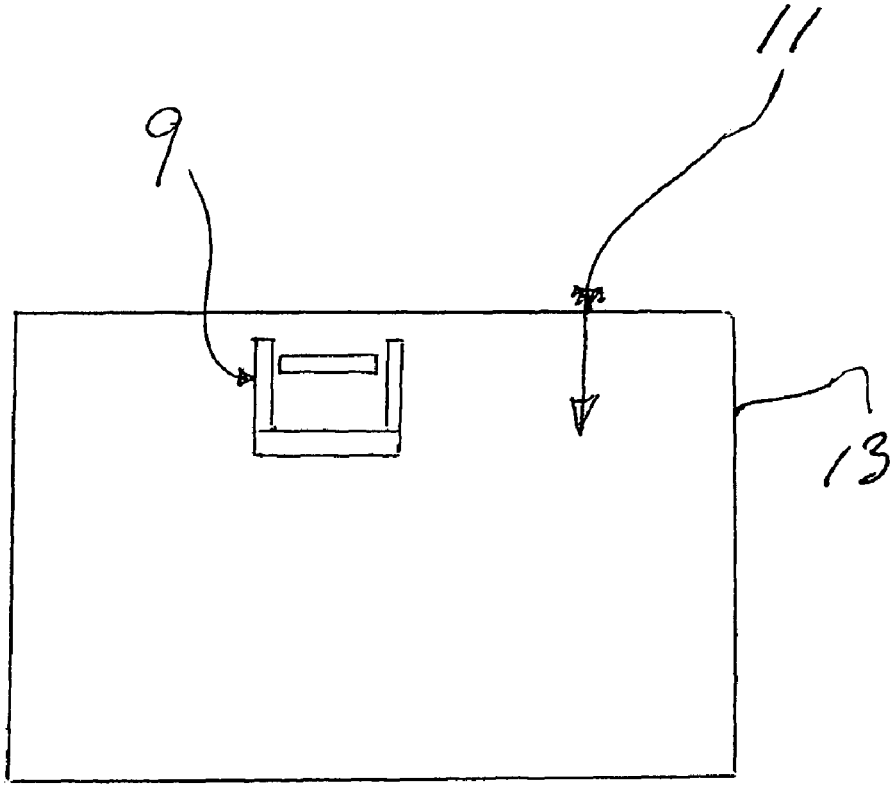

The receptacle is as already mentioned intended to be placed inside a transport container or the like space, inside which temperature sensitive goods is are arranged to be transported.

The receptacle includes a bottom part 1, a top part in the form of a lid 2 and side walls 3. The bottom and the lid and in some cases also the walls include inner and outer layers which define spaces 4 and 5, in some cases, particularly if the receptacle is high, possibly also at the positions indicated with 6. Inside the spaces 4, 5 and 6 are, in the example shown, inserted a number of bags or similar means 7 containing a second PCM of a suitable type.

Between the edges of the lid 2 and the insides of the walls 3 there are gaps 8. The lid 2, thus, is allowed to rest on top of the dry ice or first PCM arranged inside 10 the receptacle 9 and said gaps are arranged to permit the escape of evaporated gas.

Normally the entire receptacle is filled with dry ice, which results in a transformation into solid phase of the second PCM. As the said second PCM is transferred into solid state and kept so by influence of the dry ice, the receptacle 9 as a whole will form a temperature regulating element inside 11 the transport container 13 or the like. Heat leaking into the container will be consumed for melting the PCM inside the bottom and lid and, if applicable, the walls, which procedure is delayed or counter-acted by remaining dry ice.

The invention may be modified within the scope of the following claims. In one modification the first PCM is supplied in a separate box which can be positioned, e.g. by a sliding movement, into an outer receptacle having bottom, top and possibly wall parts containing second PCM. After positioning that box this way, the opening in the outer receptacle could be covered with a lid or a wall portion including second PCM. As an alternative, the box could have at least one wall containing second PCM.

Different first and second PCM materials could be utilized depending on the application and the requirements in the specific case. In particular the second PCM could be different mixtures including water, but also non-aqueous materials could also find their use with the invention.

The invention claimed is:

1. A method for obtaining and maintaining a predetermined temperature inside a goods holding space in a transport container transporting temperature sensitive or dependent goods, the transport container forming an essentially closed volume, wherein as a refrigerant agent or material is used dry ice or a first phase change material (first PCM) having a low or extremely low temperature of sublimation/evaporation, said method comprising the steps of providing a receptacle having a bottom part, a top part and side walls, and receiving the dry ice or like first PCM in the receptacle, the receptacle as a whole forming a temperature regulating element inside the transport container, the receptacle having the bottom part and the top part with double layers, defining spaces for a second phase change material (second PCM) having considerably higher phase conversion temperature than that of the first PCM, said phase conversion temperature of the second PCM also being adapted to a desired temperature range inside the transport container, the second PCM at least partially enclosing an inside of the receptacle in which the first PCM is received.

2. The method according to claim 1, including the step of arranging the receptacle with the top part being a lid of the receptacle.

3. The method according to claim 1, including the step of also arranging the walls of the receptacle with spaces for receiving the second PCM.

4. The method according to claim 1, including the step of inserting the PCM-material into the receptacle positioned at an upper part of an inside space of the container when the goods are loaded.

5. Method according to claim 1, including the further steps of inserting the second PCM in liquid state in sealed flexible receptacles into the spaces and essentially filling the spaces inside the bottom part, the top part, and the walls.

6. The method according to claim 1, including the step of selecting a second phase change material composition having solidifying and melting temperature, respectively, close to a desired temperature in the container.

7. A receptacle to be inserted into a transport container, the transport container forming an essentially closed volume, refrigerant which is dry ice or a first phase change material (first PCM) having a low or very low melting or evaporation temperature being received in the receptacle, the receptacle comprising a bottom part, a top part and side walls, at least the bottom part and the top part having inside hollow spaces containing a second phase change material (second PCM) having a far higher solidifying and melting temperature than the dry ice or the first PCM, said solidifying and melting temperature for the second PCM being more closely adapted to a desired temperature of the goods transported inside the container than that of the first PCM, the receptacle as a whole forming a temperature regulating element inside the transport container, the receptacle maintaining a predetermined temperature inside a goods holding space in the container the second PCM at least partially enclosing an inside of the receptacle in which the first PCM is received.

8. The receptacle according to claim 7, wherein the top part is a lid.

9. The receptacle according to claim 7, wherein the walls have hollow spaces for receiving said second PCM.

10. The receptacle according to claim 7, wherein the bottom and walls form a room for the reception of said first PCM, and the top part which is a separable lid is sized in such a way that it is placed inside the receptacle walls so that it rests upon the first PCM therein and there are passages for evaporated gas from the first PCM along edges of the lid.

11. The receptacle according to claim 8, wherein the second PCM inside the bottom part, the top part and the walls is enclosed into sealed flexible receptacles.

* * * * *